United States Patent [19]

Trias

[11] Patent Number: 4,783,887

[45] Date of Patent: Nov. 15, 1988

[54] MACHINE FOR CLASSIFYING, CLEANING AND ARRANGING TEXTILE TUBES

[76] Inventor: Jose R. Trias, Fontcuberta, 34-Urbanizacion "La Coromina", Manlleu (Barcelona), Spain

[21] Appl. No.: 756,964

[22] Filed: Jul. 18, 1985

[30] Foreign Application Priority Data

Jan. 22, 1985 [ES] Spain ..... 539,741

[51] Int. Cl.[4] ..... B65H 73/00

[52] U.S. Cl. ..... 28/292; 28/298; 209/700; 209/707; 209/927

[58] Field of Search ..... 28/292, 297, 298; 209/700, 707, 927

[56] References Cited

U.S. PATENT DOCUMENTS 1,227,118 5/1917 Colman ..... 209/700 X
3,195,298 7/1965 Furst ..... 209/927 X
4,097,976 7/1978 Ferguson et al. ..... 28/297
4,295,569 10/1981 Niederer ..... 209/700 X
4,404,719 9/1983 Niederer ..... 28/297
4,545,551 10/1985 Uchida et al. ..... 28/297 X

*Primary Examiner*—Robert R. Mackey
*Attorney, Agent, or Firm*—Michael J. Striker

[57] ABSTRACT

A machine for classifying, cleaning and arranging textile tubes, including an intake section for bringing in both clean tubes and tubes containing yarn residue, a classifying section which circulates the tubes so that the clean tubes are separated from the tubes containing yarn residue, a cleaning section for cleaning the yarn residue from the tubes containing the same, and an arranging section for arranging the tubes so that they are properly oriented for packaging.

11 Claims, 10 Drawing Sheets

MACHINE FOR CLASSIFYING, CLEANING AND ARRANGING TEXTILE TUBES

BACKGROUND OF THE INVENTION

The present invention relates to a machine designed for classifying, cleansing and arranging textile tubes.

Various machines of this type for the classification and arrangement of textile tubes are now known for example from Italian Pat. Nos. 748,403, 988,521, and 922,333. In these machines, inclined elemental planes are used to obtain the classification necessary. However, this leads to intermingling of clean tubes and tubes holding residues of yarn.

SUMMARY OF THE INVENTION

It is an object of the present invention to overcome the deficiencies of the prior art and to eliminate labor to the greatest extent possible by having ail operations performed automatically Pursuant to this object, and with others which will become apparent hereinafter, one aspect of the present invention resides in a machine which is electromechanical, pneumatic and hydraulic, and is fed by tubs or containers which are emptied into a storage bin by means of a dumping elevator. Tubes are then classified by means of conveyor belts, tubes with yarn residues being separated from clean tubes. The clean tubes are transported directly to the head of the arranging section of the machine and are counted and packed in removal tubs in the same direction or alternating, as necessary. The tubes with yarn residues are lifted and deposited in vibratory bins which feed a cleaning head. The vibratory bins automatically perform the operations of alignment, orientation of the tube and verification that the tube has entered the head correctly.

Because of its versatility, the machine is capable of cleaning tubes of various sizes without having to be adjusted. Alternatively, their cleaning action may be supplied independently of the arranging section.

The conveyor belts of the present invention have articulated elements which allow only the clean tubes, but not those holding residues of yarn, to fall, by gravity. This represents a great advantage over the embodiments of the Italian patents mentioned, in which recourse is necessitated to a system of inclined elemental planes to obtain in a very imperfect way the classification.

The machine of the present invention is advantageous to the prior art, since now perfect selection of the tubes is obtained, so that if upon intake into the machine a tube is lacking yarn residues, it passes immediately to conditioning for subsequent use and, if the tube appears with yarn residues, such residues are eliminated in a simple and effective way.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

The machine of the present invention is divided into four principle sections: an intake section (A), a classifying section (B), a cleaning section (C), and a final arranging section (D).

Figure 1:
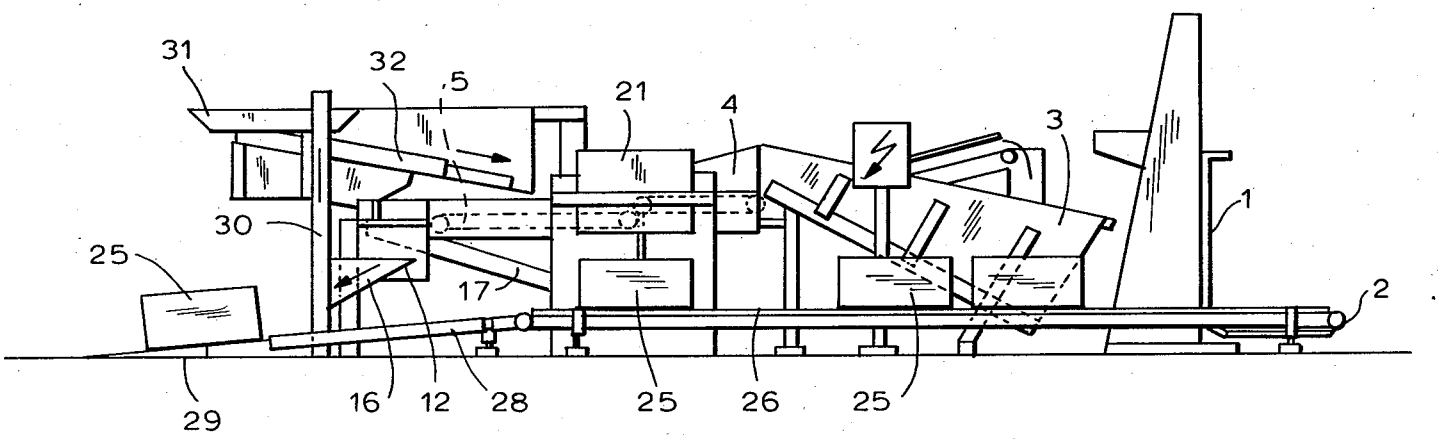
FIG. 1 is a front elevation of the assembly of the machine pursuant to the present invention.

As can be seen in FIG. 1, section A comprises an elevator 1 and a container conveyor 2, designed to dump the textile tubes (with or without yarn residues) coming from the spinning machines into a bin 3. The bin 3 is followed by endless belts 4 and 5 and an unpiling device 6 appearing at the intake of the belt 5. The unpiling device 6 is protected by another patent of the same applicant, Spanish Pat. No. 504,519, but which in the present case, has detachable rollers. Both clean textile tubes 7 and those carrying yarn residues 8 end up on this belt 5. Mixed together, these tubes enter a box 9 from which they will pass to the classifying section B which includes in this embodiment the elements represented in FIGS. 4 through 6.

Figure 4:
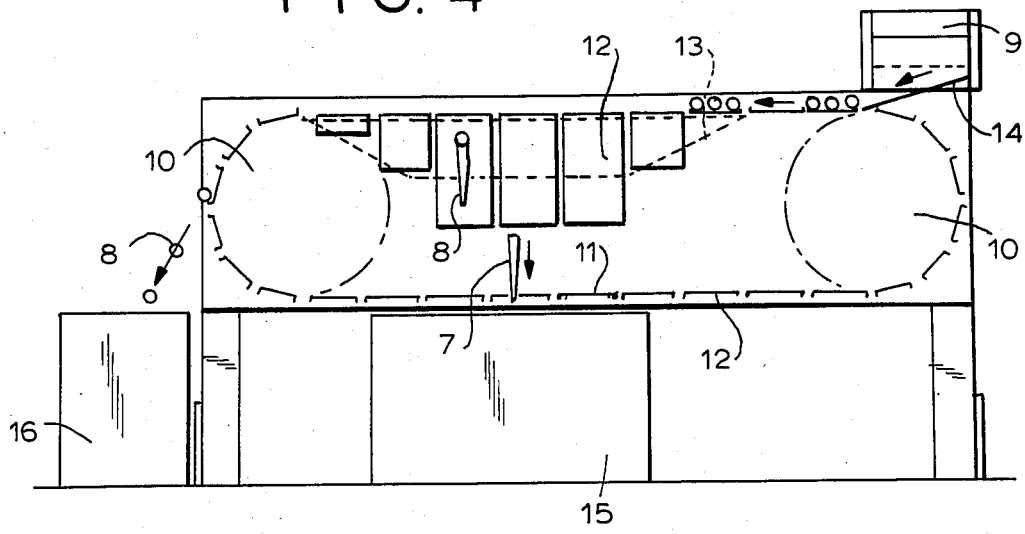
FIGS. 4, 5 and 6*a* illustrate in front, side elevation and in plan, respectively, the mechanism of the classifying section of the machine.
Figure 6A:
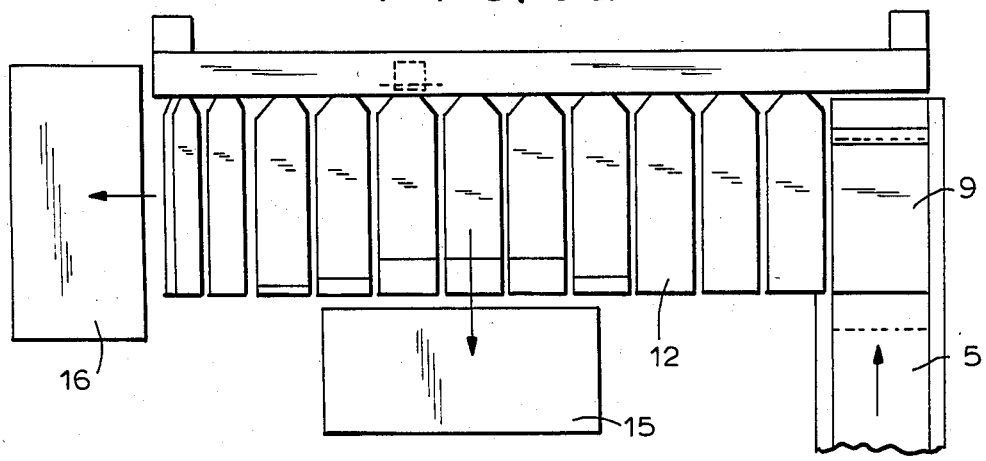
Figure 5:
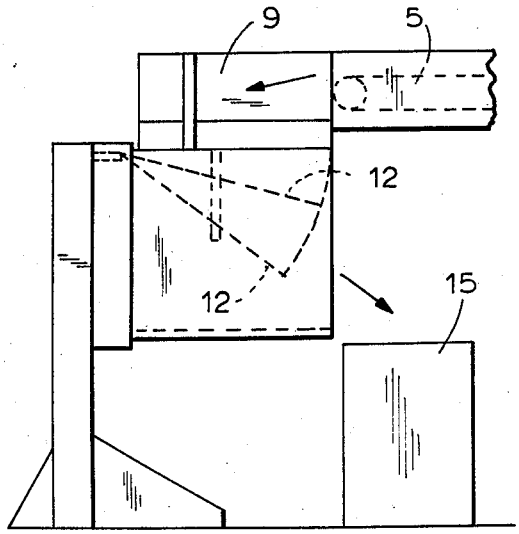
Figure 6B:
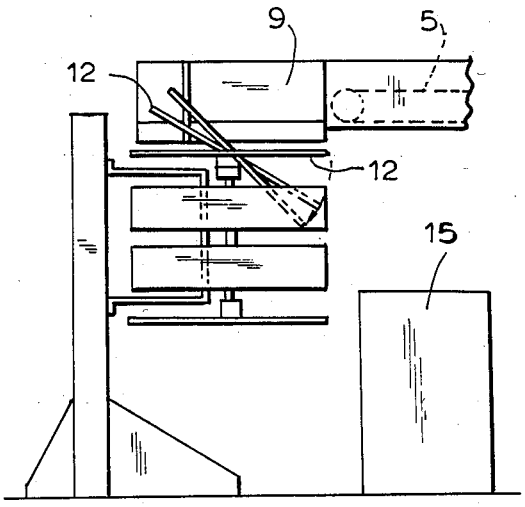
FIG. 6*b* shows another embodiment of the mechanism of FIGS. 4 through 6*a;*

This section B comprises a mechanism made of a frame on which two drums 10 are mounted to conduct a chain or endless belt 11. Articulated at one of the ends (FIGS. 4–6*a*) or else at the center (FIG. 6*b*) of the chain are multiple plates or pans 12, essentially rectangular in shape and having a wrinkled or rough upper surface. The chain 11 and pans 12 travel on a guide 13 which at the top has a section which is depressed or at a lower level and is duly shaped so that the pans 12, at their free end, i.e., at the end not articulated to the chain 11, may descend by gravity to form momentary slopes which follow one another in a continuous fashion. During the rest of the run, the pans 12 are displaced horizontally as seen in FIGS. 4–6. The tubes 7, 8 fall from the box through the plane 14 and to the belt of pans 12. When the pans reach their zone of inclination, the clean tubes 7 are unable to avoid the slope and descend into a collection box 15, while the tubes 8 bearing yarn residues stick to the rough pans 12 and are transported to the discharge of the classifying section B and deposited in another box 16. This results in an accurate separation of the originally clean tubes 7 from those bearing yarn residues. As can be seen, this mechanism takes advantage of gravity and the effect of adhesion, which has no effect when the tubes are clean, where upon they must necessarily slide. The effect of the adhesive surface of the plates or pans 12 (which has edges to contain the tubes, as seen in FIG. 4) may be due either to roughness, knurls, spines or the like, which will act to hold tubes 8 bearing yarn residues.

Figure 2:
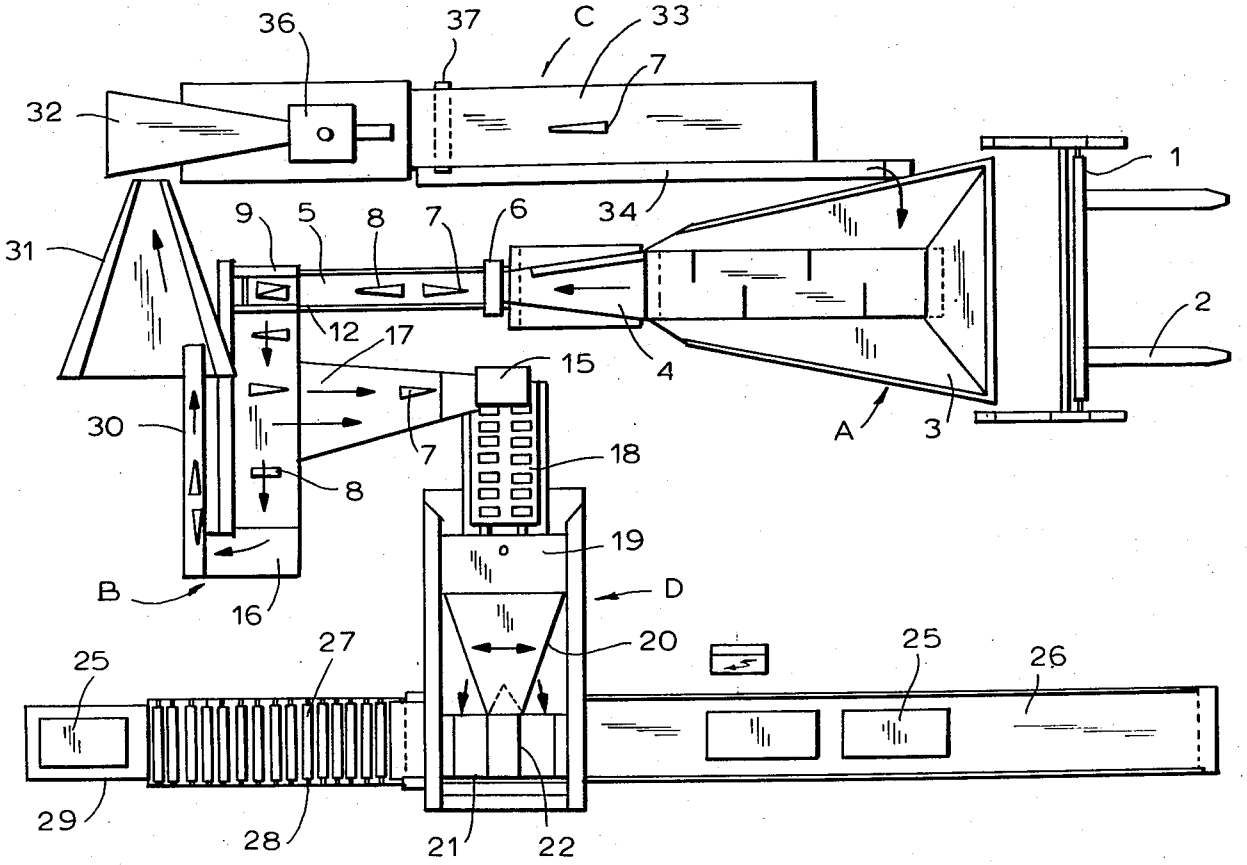
FIG. 2 is a plan view of the machine in FIG. 1.
Figure 3:
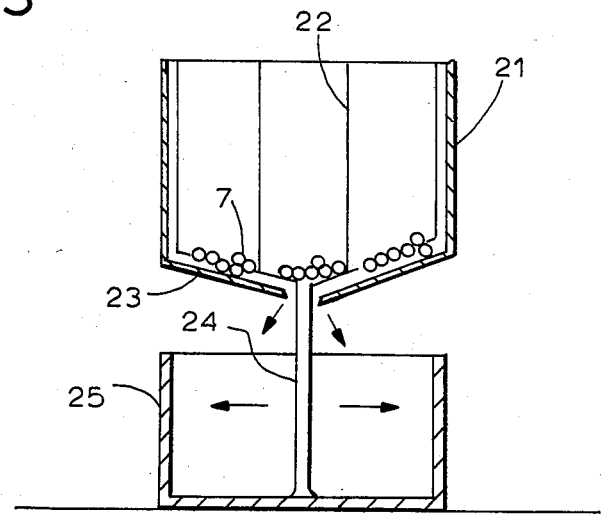
FIG. 3 is a detail of the machine showing final filling of the tubs for tubes which are already clean.

To reach the box 15, the clean tubes 7 pass through an inclined zone 17 (FIGS. 1 and 2) and are collected and raised from the box 15 by an endless belt 18 belonging to the arranging section D. The belt 18 is provided with suitable protuberances for capturing the tubes 7 and delivering them to another belt 19 in communication with channeling walls 20 which orient the tubes so that they advance with their end or base of greater diameter always directed forward, unless before reaching the walls 20 means are provided to cause the tubes 7 to move in any position toward the point of discharge which is a receptacle 21. The receptacle 21 is divided into compartments by partition 22 (FIGS. 2 and 3), and has a base made up of hinged gates 23. Two elastic sheets 24 are provided (concerning the central compartment) so as to hang vertically like curtains into tubs 25 which will be filled with the clean tubes 7. The task of the sheets 24 is to prevent tubes 7 of the central compartment from leaving, by their free fall, the orientation that they have received, this provision not being made for the side compartments because the walls of the tub 25 themselves act as a guide. The tubs 25 are transported by an endless belt 26 which delivers them to a train of rollers 27, mounted on a frame 28 from which they are collected at the end 29.

Concerning the tubes 8 with yarn residues, which fall into the box 16, they are lifted from the box 16 by an endless belt 30 which delivers them to a vibratory bin 31, which is followed by another bin 32 having the same action and has a bed 33 which is in lateral communication with an elevating conveyor belt 34 whose high discharge pan empties into the intake bin 3 of section A (FIG. 2), and in addition allows the yarn residue to fall outside the bin 3.

In the bed 33 of the cleaning section C are provided a first mechanism 36 and a second mechanism 37, whose makeup is represented in detail in FIGS. 7–8 and 9–12, respectively. The task of the first mechanism 36 is that of capturing the tubes 8 with residues (regardless of their orientation) and by means of an angular movement transferring them to the lower level where the second mechanism 37, which is a cleaner, is located. The above-mentioned angular movement, in which the tube 8 describes a perfect arc, is limited to such displacement if the captured tube 8 has been caught with its larger end or base directed forward, but if not, due to an electrical system to be explained below, the mechanism 36 automatically changes position, describing an angle of 180° to locate the larger end of the tube forward in order to deliver it properly to the following mechanism 37. The tubes which now emerge from the second mechanism 37 without yarn move onto the bin 3, but since they lack yarn, they will follow the normal path until they reach the end of the process, accommodating themselves, as previously indicated, in the tubs 25.

Figure 8:
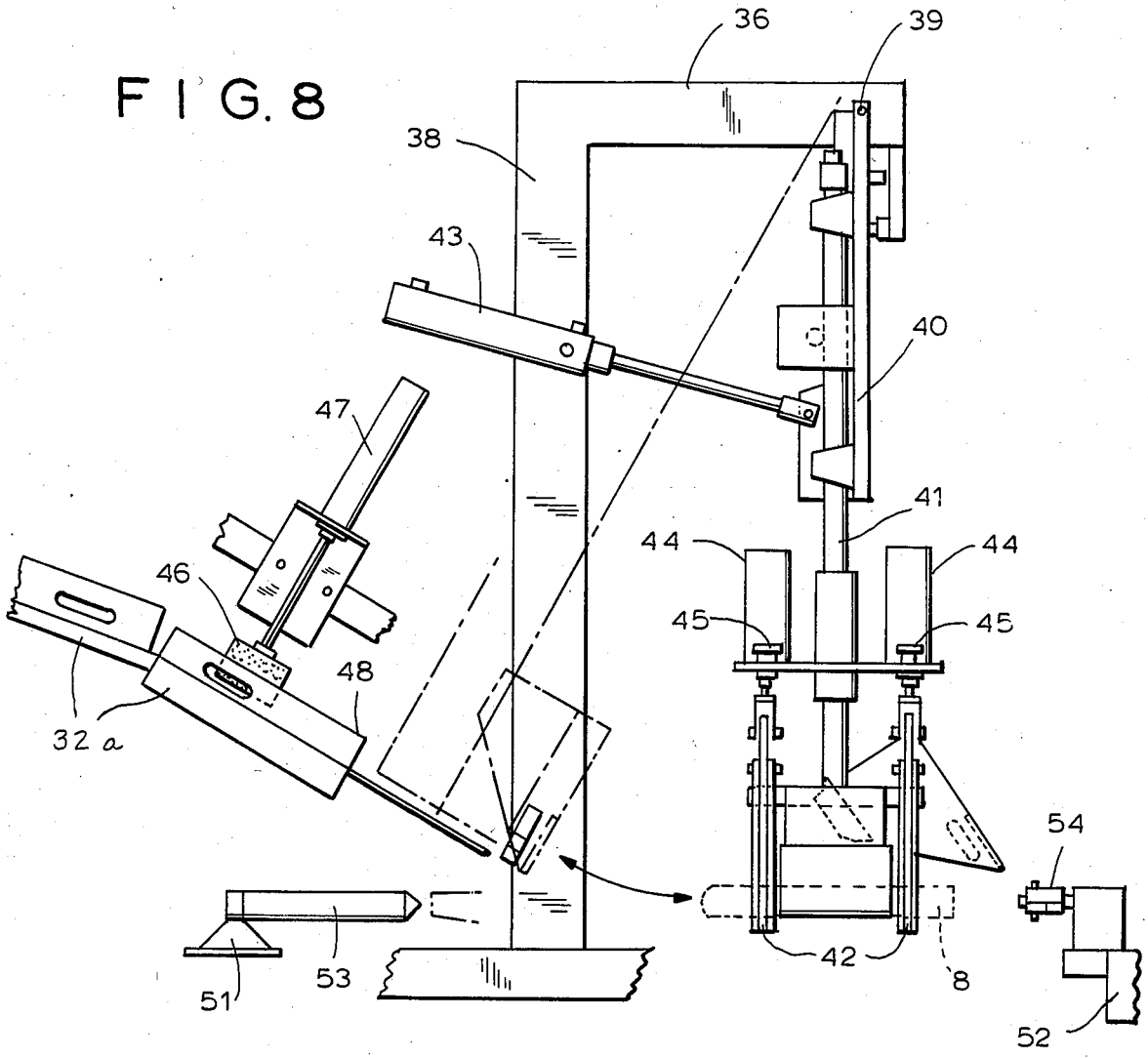
FIG. 7 and 8 are side and front elevations, respectively of the mechanism for driving, turning and aligning the textile tubes to be cleaned.
Figure 7:
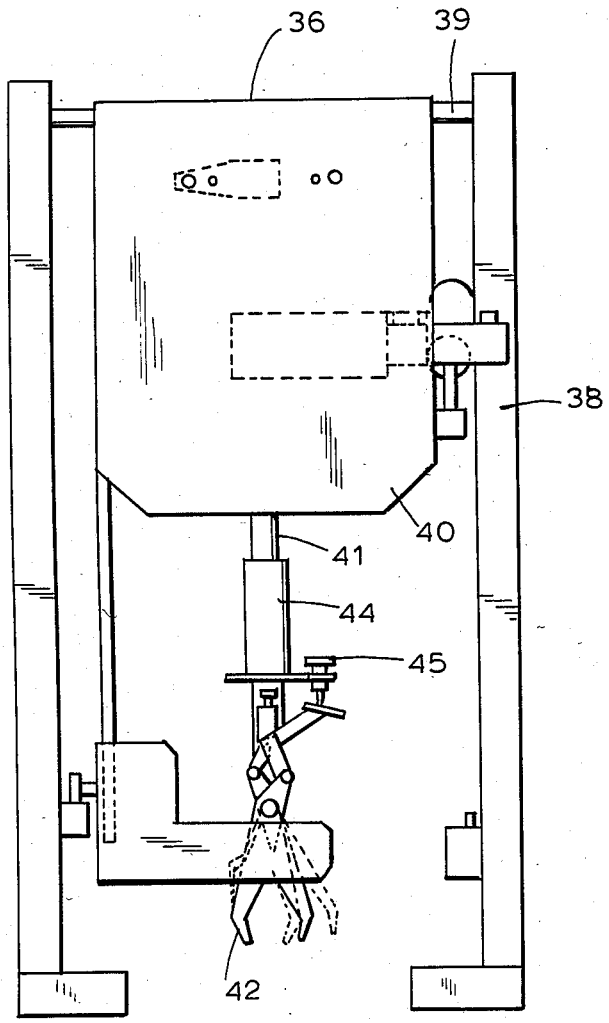
Figure 11:
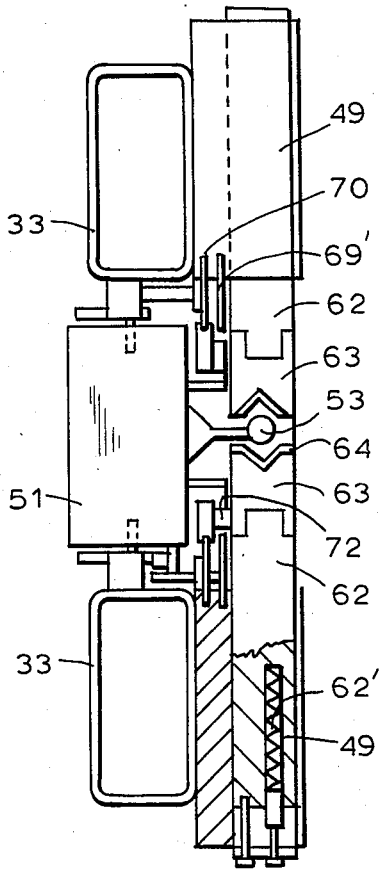
FIGS. 9, 10 and 11 show in front elevation, in plan and in partially sectioned elevation, respectively, the mechanism for cleaning tubes.
Figure 9:
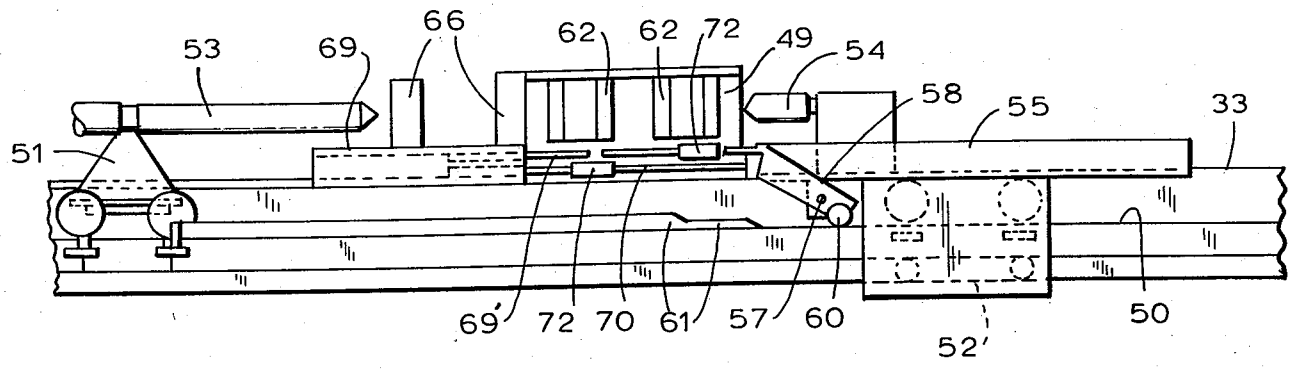
Figure 12:
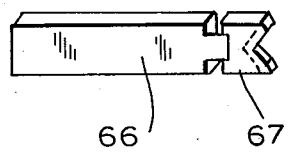
FIG. 12 shows the details of one of the elements forming part of the mechanism of FIGS. 9 through 11.

The first mechanism 36, as seen in FIGS. 7 and 8, consists of an inverted "L" support 38 in the upper part of which it is articulated to a rocking frame 40 which has a rotary shaft 41. The bottom of the rotary shaft 41 is coupled to a pair of clamps 42 which are designed to capture the tube 8 and, if the tube is oriented with its small base forward to turn it 180° about the shaft 41 by means of a pneumatic cylinder 43. Each of the clamps 42 is opened and closed by a pneumatic cylinder 44, and microswitches 45, acting as a function of the outside diameter of the respective clamp, are used for the above-mentioned reversal direction.

At the lower end of a slope 32*a*, by which the tubes 8 with yarn residues descend, an element is arranged for braking the tubes, including a spongy member 46 movable axially with the aid of another pneumatic cylinder 47. The spongy member 46 holds back the tubes 8, without injuring them, in rhythmic fashion so that upon passing through a constricted mouth 48 they emerge one by one and can be caught by the clamps 42.

The second mechanism 37 follows the first mechanism 36, and as can be seen in FIGS. 9–12 consists of two boxes 49 fixed to two stringers comprising the bed 33, which on the inside each has a rail or longitudinal guide 50 by which two cars 51, 52, which are provided with a special rolling system, may be displaced. Of these cars, a first one 51 is the bearer of a centering and retention tip 53 of the tube 8, while the second car 52 has a second tip 54 and two stringers 55 with beveled ends 56. The second car 52 also has a transverse front shaft 57, with two lateral pawls 58 tensioned by a spring 59 and each having a roller 60 supported on a guide 50 which in a given sector, has a double step 61 for the pawls 58 to assume two levels in their advance.

In the boxes 49 are housed two pairs of slides 62 elastically compressed by means of spring 62', and to which jaws 63 are articulated. The jaws 63 are equipped with mouths at an angle and provided with semi-hard linings so as not to injure the tube 8. These jaws 63 are tightly held in a position of mutual closure by the effect of a plurality of springs 65. Contiguous to the displaceable slide 62 are two slats 66 fixed to the stringers of the bed 33 and equipped with further articulated jaws 67, with a likewise angular mouth (FIG. 12), which are in plane position and pressed by springs 68. This system for articulation for the slides 62 and slats 66 is such that all of the jaws open in one direction (see arrows on drawings), i.e., they automatically close in the direction of advance of the tip 53.

Below the boxes 49 and an addition 69, two flat cutout cams or templets 69' and 70 are mounted sliding with one superposed on the other. The cams 69', 70 have an inclined edge 71 which contacts with rollers 72 integral with the slide 62. The cams 69', 70 in addition have an edge 73 and a tail by which they are each joined to a return spring 74.

Figure 10:
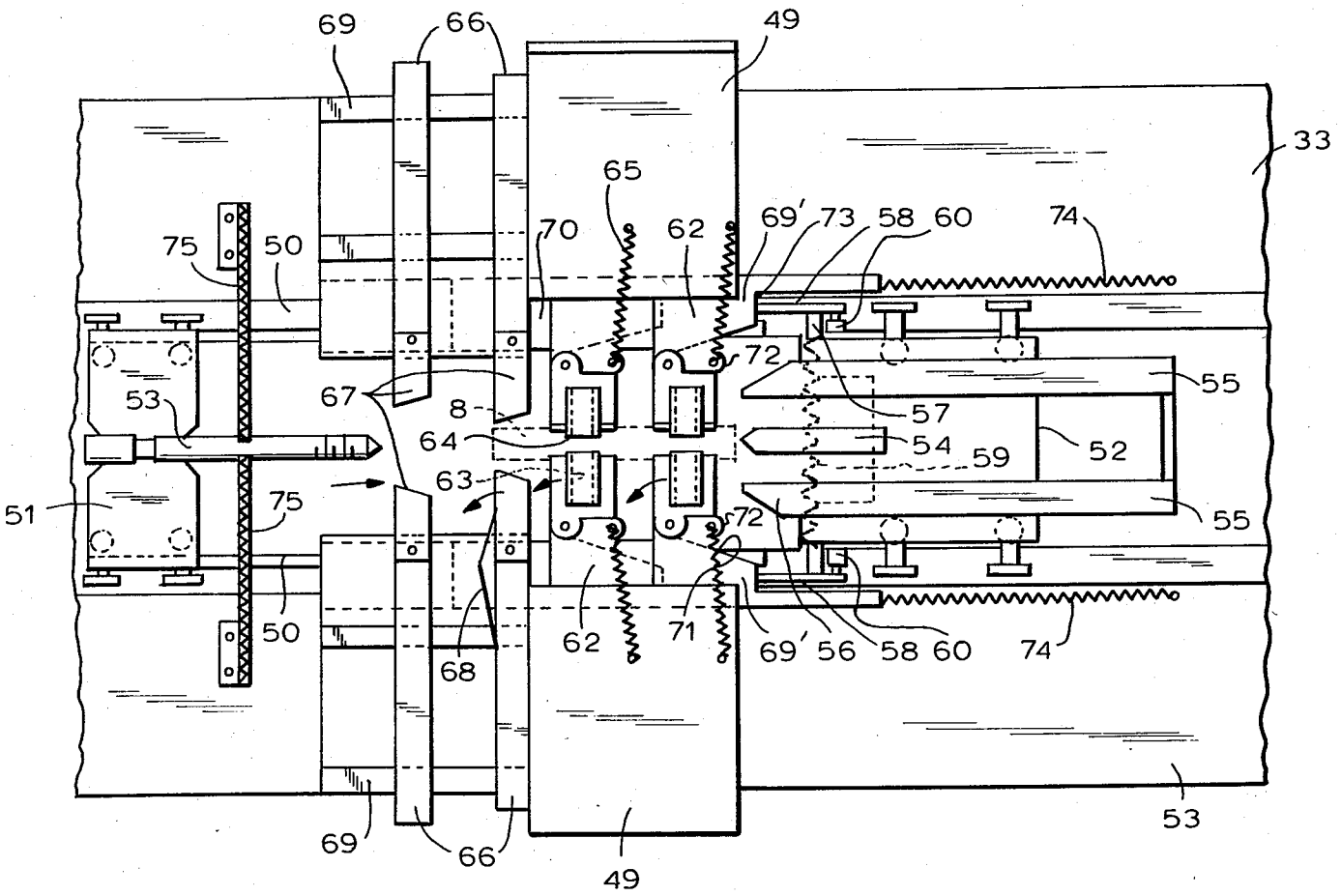

The mechanism described is completed by elastic strips 75 fixed to the stringers of the bed 33. The end of the elastic strips 75 define a mouth like that of the aforementioned jaws, applied in this case, about the tip 53 (FIG. 10).

The extraction of a tube 8, which happens to be caught by the jaw 63 due to defect or fracture of the tube, is effected gently owing to the recovery of the jaws, all of this being done in response to the impulse of the guide tip 54.

Concerning extraction of the yarn, this takes place in such a way that the tube 8 is not captured but rather that the pressure on the tube is minimal. In the phase of extraction, the templets or cams 69, 70, together with the rollers 72, makes the backward motion of the jaws 63 impossible.

Figure 13:
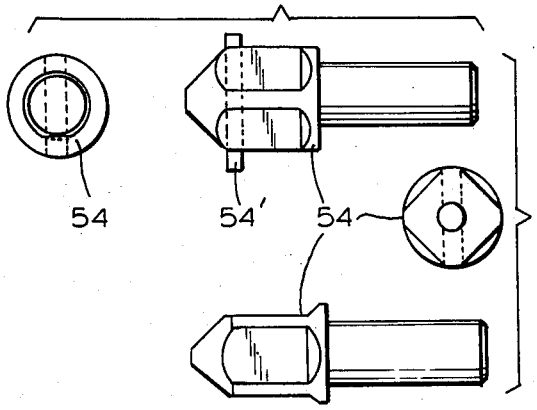
FIGS. 13 through 19 show various centering and fixing tips for the textile tubes to be cleaned.
Figure 14:
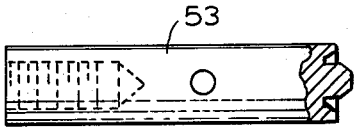
Figure 15:
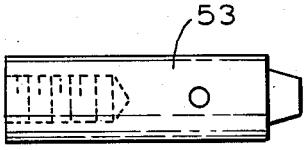
Figure 16:
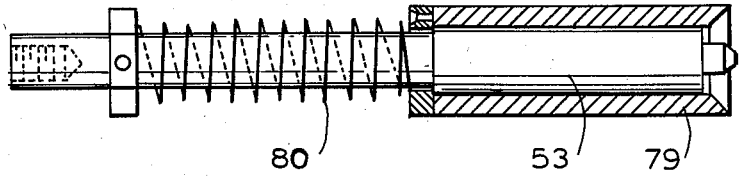
Figure 18:
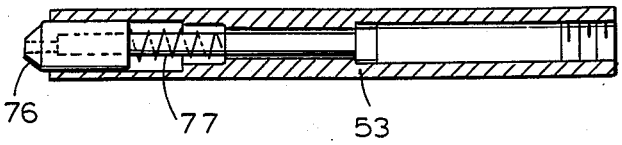
Figure 17:
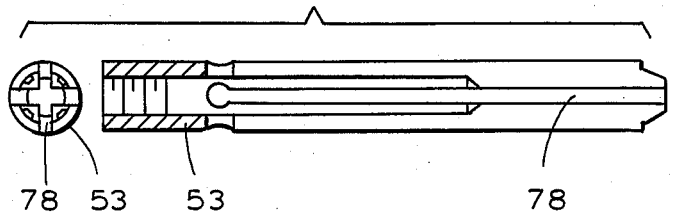
Figure 19:
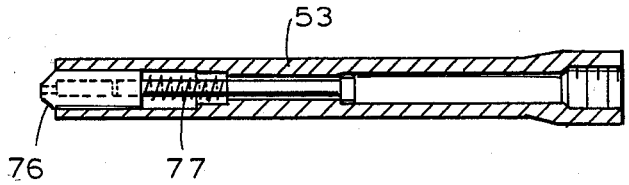

With regard to the centering and retention tip used, the second tip 54 (for the larger base of the tube) has the compact structure represented in FIG. 13 in which is shown a transverse shaft 54' which serves upon its passage to clear the yarn residues which may possibly remain between the jaws 64. The other tip 53 may have a variety of shapes. For example, it may be compact (FIGS. 13 and 14), have a telescopic retractable end 76 pressed by springs 77 (FIGS. 18 and 19), have section in the form of a cross 78 so that it may be compressed and expanded radially (FIG. 17), or, it may be provided with a displaceable sleeve 79 compressed by a spring 80 to facilitate expulsion of the leftover yarn deposit about the tip 53, as will be explained below.

Figure 20:
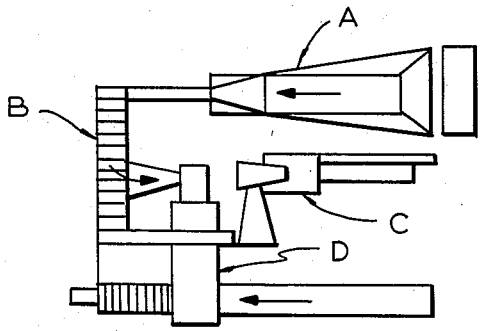
FIGS. 20 and 21 are schematic plan view of two possible embodiments of the tube classifying mechanism of FIG. 4 through FIGS. 22 and 23 are a front elevation and a plan view, respectively, of a machine pursuant to the present invention designed to function only as a cleaner.
Figure 21:
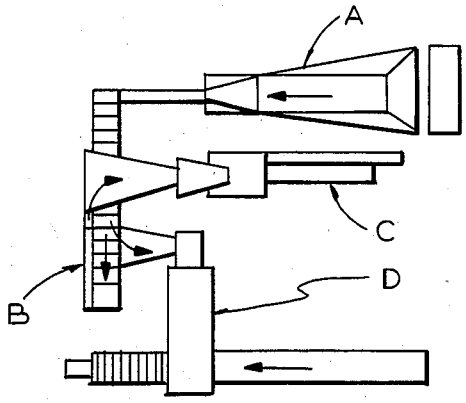

Schematic FIGS. 20 and 21 reproduce the embodiment mentioned above as concerns location and shape of the classifying section. Thus, FIGS. 20 and 21 coincide with FIG. 2 except in the location of the cleaning section C.

Figure 22:
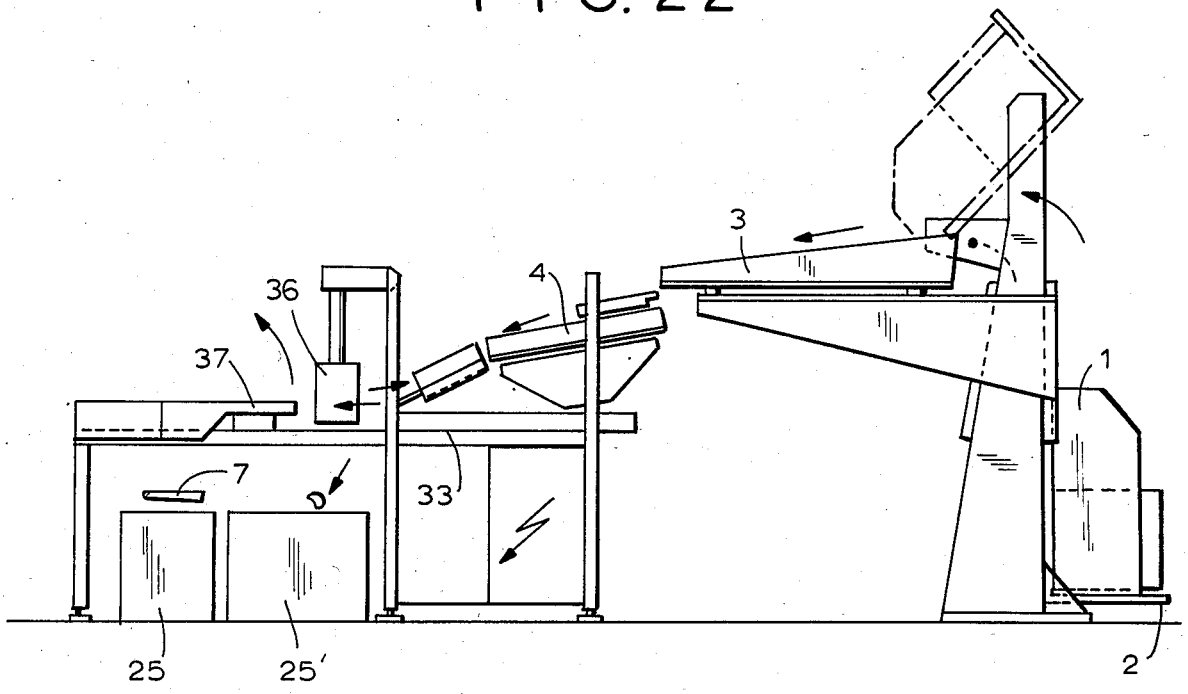
Figure 23:
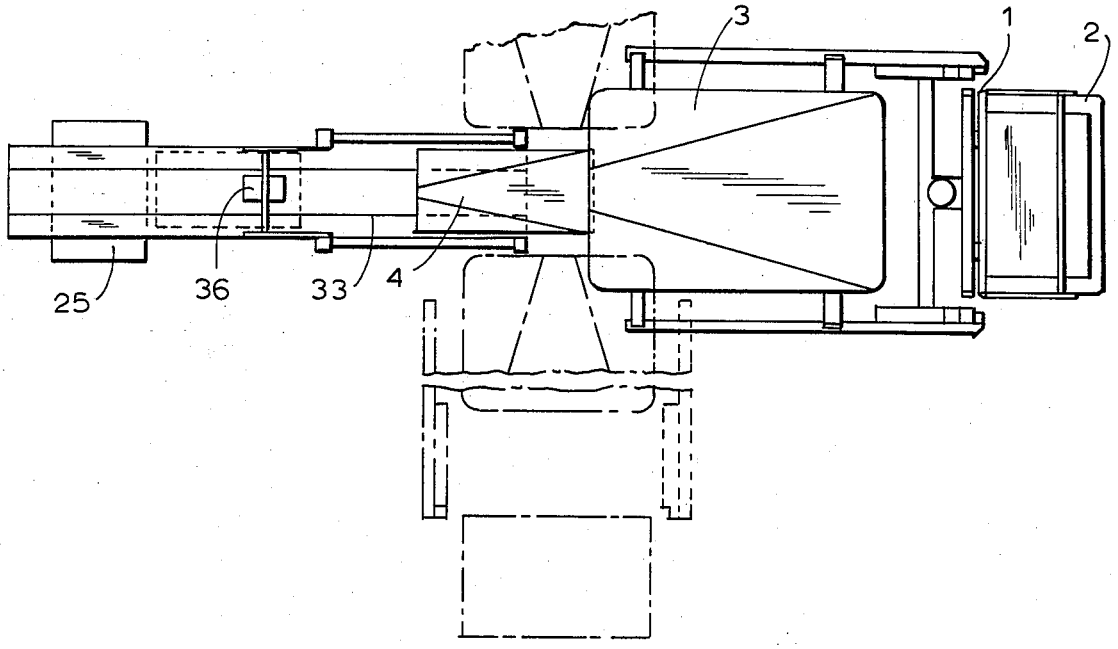

The machine described thus far is designed to perform three fundamental operations, which are the classification, cleaning and arrangement of textile tubes. However, a simplification is shown in FIGS. 22 and 23, wherein only the cleaning of tubes is accomplished. In this simplified machine, the elevator 1,2, the intake bin 3, the following belt 4, and the bed 33, along with the first mechanism 36 (capture and turning) and the second mechanism 37 (yarn-residue removal) are alternatively used. The clean tube 7 falls directly into the tub 25, while the residues fall onto another similar tub 25'. The dotted lines in FIG. 23 indicate that, instead of a linear assembly of the above-mentioned element, another one at a right angle may be adopted, with the same results and mode of operation as mentioned above.

In addition to the components described, the machine pursuant to this application has other conventionally used elements, such as electric controls for operation of the various mechanical and hydraulic parts mentioned, the elements of which are not explained because their makeup and mode of operation are standard in this technology.

The operation of the above-mentioned machine is clearly evident from what is set forth above, it being sufficient merely to summarize with the following points:

The mixed tubes 7, 8 without and with yarn residues, are dumped from the elevator 1 into the bin 3 and passed through the unpiling zone 6 into the classifying mechanism (section B) which separates the clean tubes 7 from the tubes 8 containing yarn. The clean tubes 7 go to the arranging section D, in which the placement of the clean tubes 7 in a single direction within the tubs 25 receiving them takes place. The orientation is insured by the elastic channeling device appearing in detail in FIG. 3.

The tubes 8 containing yarn are transported (passing through the vibratory bins) to the cleaning section C, where the 20 first mechanism 36 for capture and turning and the second mechanism 37 for extraction or removal of yarn, leave the tubes clean. In this condition they again enter the bin 3, while the yarn residues fall into a suitable tub (such as 25' in FIGS. 22 and 23). The path followed by the tubes, now clean, from the bin 3 until they reach the arranging section, passing through the classifying section B, is the one which has already been described above. Final collection takes place, as always in the tub 25.

The points of novelty which it is of interest to emphasize in this machine are those relating to the structure and operation of the classifying section, which hitherto was limited to a simple inclined plane, in charge of effecting separating of the tubes. This invention uses a system of an endless chain or belt formed by the plates or pans 12, which are sloped only in a given stretch of their length, which is when the clean tubes (which slip easily because they carry no yarn residues) must be allowed to fall by gravity, while the tubes with yarn do not descend despite their momentary inclination, due to the roughness of the pans themselves, on which the yarn sticks. The embodiments of this mechanism are variable as is shown by the figures, wherein mechanically feasible embodiments are represented in detail. In all cases the motion described, and separation by gravity and adhesion are always fundamental.

The function of the mechanism of capture and turning of the tubes in the cleaning section C (FIGS. 7 and 8) is likewise important. The textile tubes 8 regardless of their orientation, are elastically detained by the spongy member 46 and are then held by the clamps 42, which rotate 180° only if the tubes arrive with their smaller end or base in front, being oriented so that they may immediately be grabbed by the jaws 63 and tips 53 and 54. Displacement of the car 52 is what, by way of its beveled stringers 55, separates the jaws from one another, causing their slide 62, driven by the stringers 55 themselves and over the roller 72, to penetrate into the boxes 49. If backward motion of the rollers 72 coincides exactly with the advance of the cams or templets 69', 70, which are driven by the pawls 58 and which go on to situate their inclined plane 71 in contact with the rollers 72, then backward movement of the slides 62 is permitted. When the tip 63 advances, the yarn residue contained on the tube 8 (which is likewise displaced with the jaws 63), goes on to be situated on the tip 53 (see FIG. 10). The tube 8 thus being left clean so that when, subsequently, the jaw 63 opens, it falls on the belt 34, to travel into the bin 3. The movement backward of the tip 53 causes the yarn which it has grabbed to be detached upon striking against the elastic strips 75. This residue falls and is collected in a tub (for example, the tub 25').

The jaws 67, contiguous to the jaws 63 previously mentioned, are separated more from one another than are jaws 63, owing to the fact that they go into operation only when there is a large amount of yarn to be removed from the tube 8. If this is the case, these auxiliary jaws 67 remove the first layers of the yarn so that the regular jaws 63 may perform the operation described above.

Upon examination of FIG. 10, it is found that a perfect coordination of movements exists for this mechanism to capture the tube 8, to remove the residues of yarn from it and leave it free for its automatic fall. This is a question of combined operations obtained perfectly by the operation of the elements visible in the figure. For example, the reason for orientation in one and the same direction in articulation of the jaws 63 and 67, the function of the spring 74 for return of the cams or templets 69', 70, the task of the pawls 58 tensioned elastically, the adaption of the double step 61, necessary for the pawls 58 to act first on the upper cam 69' and then on the lower one 70, and other functional details, are clearly understandable per se.

The materials, shape and dimensions of the elements comprising the classifying, cleaning and arranging machine having the features described will be independent of the subject matter of the invention, provided that the variations introduced do not affect its essential nature.

While the invention has been illustrated and described as embodied in a machine for classifying, cleaning and arranging textile tubes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A machine for classifying, cleaning and arranging textile tubes, comprising:

means for taking in the textile tubes including clean tubes and tubes containing yarn residues;

means for classifying the tubes including means for circulating the tubes so that the clean tubes are separated from the tubes containing yarn residue and including a guide;

means for cleaning the yarn residue from the tubes containing yarn residue; and means for arranging the tubes so that they can be uniformly stacked, said circulating means of said classifying means including a plurality of adhesive members and conveyor means for conveying the textile tubes on said plurality of adhesive members, said plurality of adhesive members being pivotally articulated to said conveyor means, said guide being formed so that when said plurality of adhesive members travel on said guide, the clean tubes being conveyed fall off by gravity and yet the tubes with yarn residue that are being conveyed are retained by said plurality of adhesive members.

2. A machine for classifying, cleaning and arranging textile tubes, comprising:

means for taking in the textile tubes including clean tubes and tubes containing yarn residues;

means for classifying the tubes including means for circulating the tubes so that the clean tubes are separated from the tubes containing yarn residue;

means for cleaning the yarn residue from the tubes containing yarn residue; and means for arranging the tubes so that they can be uniformly stacked, said circulating means of said classifying means including conveyor means and a plurality of adhesive members articulated to said conveyor means for conveying the textile tubes on said plurality of adhesive members, said plurality of adhesive members being formed so that each is pivotable where articulated to said conveyor means to cause the clean tubes being conveyed to fall off by gravity and yet retain the tubes with yarn residue that are being conveyed, said classifying means further including a first box and a second box, said conveyor means being formed as an endless conveyor means, said adhesive members having a rough-surface, said classifying means also including a guide having a lower level section, said adhesive members and said conveyor means traveling on said guide so that when said lower level section is reached said adhesive members successively slope downwardly because of gravity so as to cause the clean tubes to fall into said first box, the tubes with yarn residue remaining stuck to said adhesive members and subsequently falling by gravity into said second box.

3. A machine as defined in claim 2, wherein said endless conveyor means includes an endless chain guided by end drums.

4. A machine as defined in claim 2, wherein said endless conveyor means includes an endless belt guided by end drums.

5. A machine as defined in claim 2, wherein said plurality of adhesive members are plates.

6. A machine as defined in claim 2, wherein said plurality of adhesive members are pans.

7. A machine as defined in claim 2, wherein said intake means includes, a jointed endless belt having an end and provided so as to transport the textile tubes to said classifying means, an elevator for supplying the textile tubes, and a box provided at said end of said endless belt so that the textile tubes fall onto said conveyor means of said classifying means, said circulating means of said classifying means further including a wall provided on either side of said adhesive members so as to hold the textile tubes in a horizontal position.

8. A machine as defined in claim 2, wherein said rough surface comprises a plurality of spines.

9. A machine as defined in claim 2, wherein said rough surface comprises a plurality of spines.

10. A machine as defined in claim 2, wherein said adhesive members of said circulating means have a rectangular shape and said endless conveyor means of said circulating means being guided by end drums which have horizontal axes, thereby moving said adhesive members in a horizontal plane.

11. A machine as defined in claim 2, wherein said arranging means includes a receiving tub, said classifying means further including an endless belt, vibratory bins, and an inclined plane member, coinciding with said lower-level section of said guide, said plane member being provided so as to empty the clean tubes into said first box, said arranging means delivering the clean tubes from said first box to said receiving tub in a perfectly oriented manner, said endless belt of said classifying means being provided so as to guide the tubes with yarn residue from said second box to said vibratory bins which in turn send the tubes to said cleaning means.

* * * * *